US008824931B2

(12) United States Patent
Nelson et al.

(10) Patent No.: US 8,824,931 B2
(45) Date of Patent: Sep. 2, 2014

(54) LIQUID MARKING AGENT DEVELOPMENT ASSEMBLIES AND LIQUID MARKING AGENT HARD IMAGING METHODS

(75) Inventors: Eric G. Nelson, San Diego, CA (US); David Sabo, San Diego, CA (US); David Vejtasa, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 276 days.

(21) Appl. No.: 13/380,013

(22) PCT Filed: May 29, 2009

(86) PCT No.: PCT/US2009/045721
§ 371 (c)(1),
(2), (4) Date: Dec. 21, 2011

(87) PCT Pub. No.: WO2010/138129
PCT Pub. Date: Dec. 2, 2010

(65) Prior Publication Data

US 2012/0148311 A1 Jun. 14, 2012

(51) Int. Cl.
*G03G 15/10* (2006.01)

(52) U.S. Cl.
USPC ..... 399/240

(58) Field of Classification Search
USPC ..... 399/237, 239, 240
See application file for complete search history.

(56) References Cited

U.S. PATENT DOCUMENTS

| | | | | |
|---|---|---|---|---|
| 7,024,126 | B2 * | 4/2006 | Kellie et al. | 399/57 |
| 2005/0053398 | A1 * | 3/2005 | Kim et al. | 399/237 |
| 2005/0158082 | A1 * | 7/2005 | Shin et al. | 399/237 |
| 2005/0180766 | A1 * | 8/2005 | Shin et al. | 399/55 |
| 2006/0291907 | A1 * | 12/2006 | Tanner et al. | 399/237 |
| 2012/0148310 | A1 * | 6/2012 | Nelson et al. | 399/237 |

FOREIGN PATENT DOCUMENTS

| | | | |
|---|---|---|---|
| EP | 1 349 017 | A2 | 10/2003 |
| JP | 62-090686 | A | 4/1987 |
| JP | 05-046029 | A | 2/1993 |
| JP | 2005-196200 | A | 7/2005 |
| WO | WO-2010138129 | A1 | 12/2010 |

OTHER PUBLICATIONS

Hewlett-Packard Development Company, L.P., International Search Report and Written Opinion dated Aug. 31, 2009, PCT App. No. PCT/US2009/045721, filed May 29, 2009, 11 p.

* cited by examiner

*Primary Examiner* — Walter L Lindsay, Jr.
*Assistant Examiner* — Rodney Bonnette

(57) ABSTRACT

Liquid marking agent development assemblies and liquid marking agent hard imaging methods are described. According to one aspect, a liquid marking agent development assembly includes a developer member comprising an outer surface and a charging assembly adjacent to the outer surface of the developer member, and wherein the charging assembly comprises at least one roller member configured to provide substantially an entirety of an electrical field relative to the developer member which electrical field is used to direct a plurality of ink particles of a liquid marking agent to the outer surface of the developer member and which ink particles upon the outer surface of the developer member are used to develop latent images upon an imaging member.

11 Claims, 6 Drawing Sheets

LIQUID MARKING AGENT DEVELOPMENT ASSEMBLIES AND LIQUID MARKING AGENT HARD IMAGING METHODS

CROSS-REFERENCE TO RELATED APPLICATION

The present application is the U.S. National Stage under 35 U.S.C. §371 of International Patent Application No. PCT/US2009/045721, filed 29 May 2009, the disclosure of which is hereby incorporated herein by reference.

BACKGROUND OF THE DISCLOSURE

Imaging devices capable of printing images upon paper and other media are ubiquitous and used in many applications including monochrome and color applications. For example, laser printers, ink jet printers, and digital printing presses are but a few examples of imaging devices in wide use today for monochrome or color imaging.

Electrophotographic imaging processes utilize a photoconductor which may be electrically charged and then selectively discharged to form latent images. The latent images may be developed and transferred to output media to form hard images upon the media. Electrophotographic imaging processes may be implemented in laser printer configurations and digital presses in illustrative examples.

At least some aspects of the disclosure are directed to improved hard imaging devices and methods for forming hard copy images upon media.

DESCRIPTION OF THE DRAWINGS

FIG. 5 is an illustrative representation of a development assembly of a hard imaging device according to one embodiment.

DETAILED DESCRIPTION

According to some embodiments of the disclosure, hard imaging devices and hard imaging methods utilize a marking agent to develop and form hard images upon media. An example marking agent which may be used includes a liquid marking agent. One example of a liquid marking agent comprises ink particles (e.g., cyan, magenta, yellow or black in one example) suspended in a liquid carrier fluid, such as oil (e.g., Isopar-L available from the ExxonMobil Corporation). One suitable liquid marking agent is Electroink® available from the Hewlett-Packard Company.

During example development operations using a liquid marking agent, the ink particle concentration of the liquid marking agent is increased by several times in a development assembly and the liquid marking agent is applied to an imaging member to develop latent images formed thereon and at least a substantial portion of the liquid carrier is removed or evaporates prior to transfer of the ink particles to media. Some example embodiments of the disclosure described herein provide different configurations of the development assembly which may be used.

Figure 1:
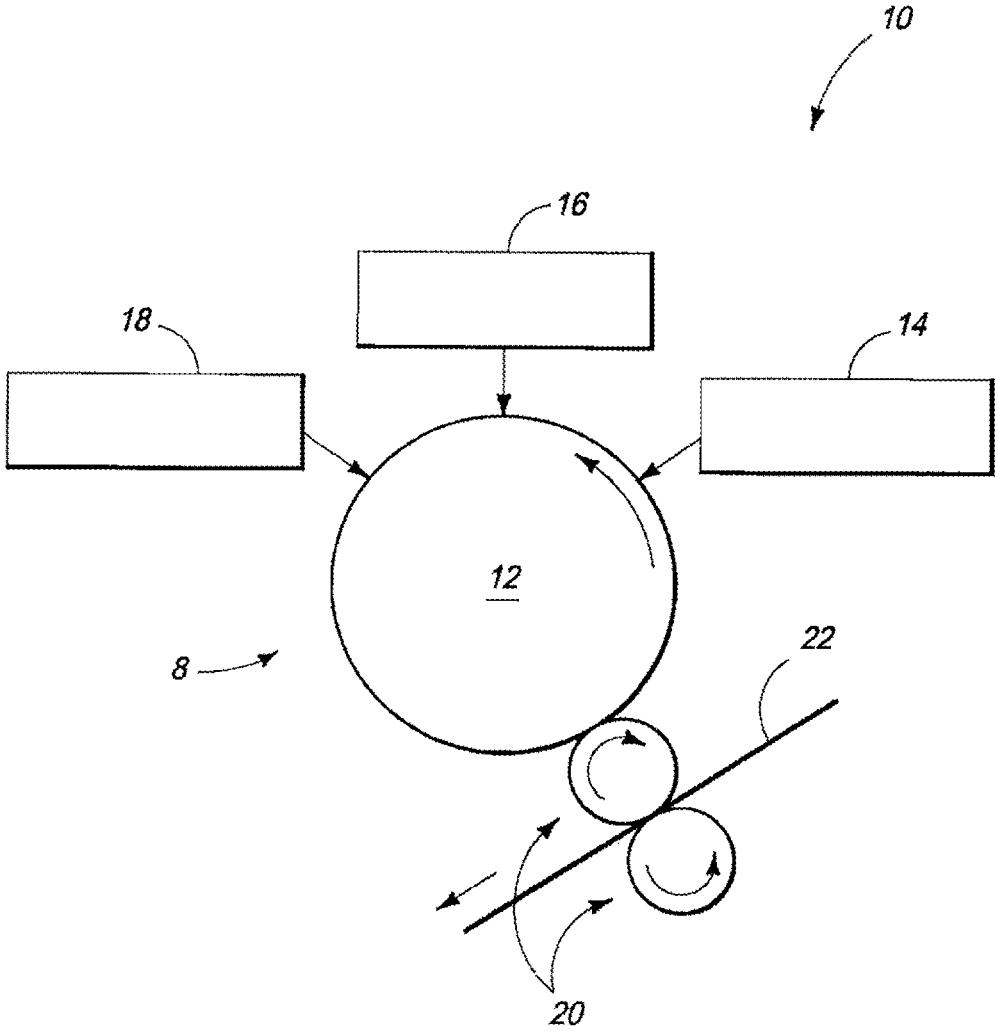
FIG. 1 is an illustrative representation of a hard imaging device according to one embodiment.

Referring to FIG. 1, an example of an image engine 8 of a hard image device 10 is shown according to one illustrative embodiment. The depicted arrangement of the hard imaging device 10 is configured to implement electrophotographic imaging wherein latent images are developed to form developed images which are subsequently transferred to output media to form hard images. Examples of hard imaging devices 10 include digital presses (e.g., Indigo® presses available from the Hewlett-Packard Company) which utilize a liquid marking agent although other configurations may be used.

The image engine 8 of hard imaging device 10 depicted in FIG. 1 includes an imaging member 12, a charging assembly 14, a writing assembly 16, a development assembly 18, and a transfer assembly 20. Hard imaging device 10 is configured to form hard images upon media 22, such as paper or other suitable imaging substrates. Other hard imaging devices 10 may include more, less or alternative components or other arrangements in other embodiments.

In one operational embodiment, charging assembly 14 is configured to deposit a blanket electrical charge upon substantially an entirety of an outer surface of imaging member 12 which may be implemented as a photoconductor, such as a photo imaging plate, photoconductive belt or drum. Writing assembly 16 is configured as a laser in one embodiment to discharge selected portions of the outer surface of the imaging member 12 to form latent images. Development assembly 18 may be referred to as a binary ink developer (BID) in one embodiment which is configured to provide a layer of marking agent to the outer surface of imaging member 12 to develop the latent images formed thereon. In one embodiment, the marking agent may be a liquid marking agent as discussed above. Ink particles of the liquid marking agent may be electrically charged to the same electrical polarity as the blanket charge provided to the outer surface of the imaging member 12 and attracted to the discharged portions of the outer surface of the imaging member 12 corresponding to the latent images to develop the latent images in one embodiment. The developed images are transferred by transfer assembly 20 to media 22.

Figure 2:
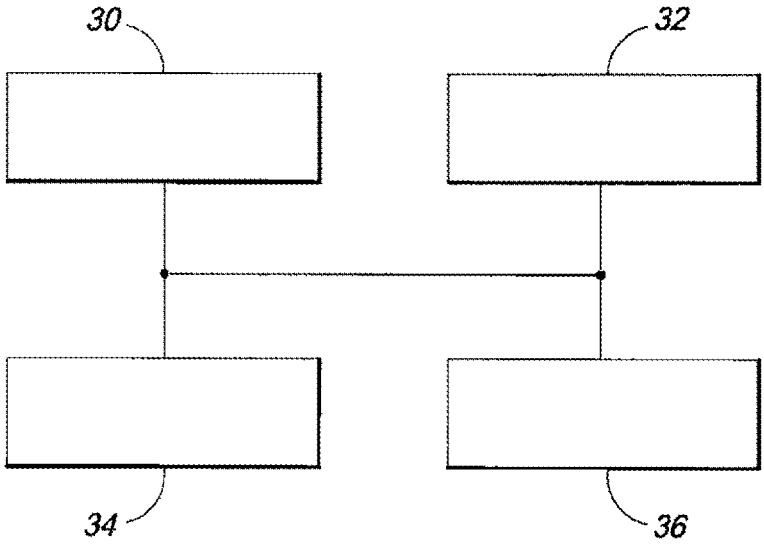
FIG. 2 is a functional block diagram of circuit components of a hard imaging device according to one embodiment.

Referring to FIG. 2, an example of circuit components of hard imaging device 10 is illustrated according to one embodiment. The circuit components include a communications interface 30, processing circuitry 32, storage circuitry 34 and device components 36 in one embodiment of hard imaging device 10. More, less or alternative components are provided in other embodiments of hard imaging device 10.

Communications interface 30 is arranged to implement communications of hard imaging device 10 with respect to external devices (not shown). For example, communications interface 30 may be arranged to communicate information bi-directionally with respect to device 10. Communications interface 12 may be implemented as a network interface card (NIC), serial or parallel connection, USB port, Firewire interface, flash memory interface, floppy disk drive, or any other suitable arrangement for communicating with respect to device 10. In one example, image data of hard images to be formed may be received by communications interface 30.

In one embodiment, processing circuitry 32 is arranged to process data, control data access and storage, issue commands, and control imaging operations of device 10. Processing circuitry 32 may comprise circuitry configured to implement desired programming provided by appropriate media in at least one embodiment. For example, the processing circuitry 32 may be implemented as one or more of a processor and/or other structure configured to execute executable instructions including, for example, software and/or firmware instructions, and/or hardware circuitry. Exemplary embodiments of processing circuitry 32 include hardware logic, PGA, FPGA, ASIC, state machines, and/or other structures alone or in combination with a processor. These examples of processing circuitry 32 are for illustration and other configurations are possible.

Processing circuitry 32 is configured to control imaging operations of device 10, such as the formation and development of latent images upon imaging member 12. Processing circuitry 32 may also operate as a control system in some embodiments described below to control movements of rollers, supply of the marking agent, and other imaging operations.

The storage circuitry 34 is configured to store programming such as executable code or instructions (e.g., software and/or firmware), electronic data, databases, image data, or other digital information and may include processor-usable media. Processor-usable media may be embodied in any computer program product(s) or article of manufacture(s) which can contain, store, or maintain programming, data and/or digital information for use by or in connection with an instruction execution system including processing circuitry in the exemplary embodiment. For example, exemplary processor-usable media may include any one of physical media such as electronic, magnetic, optical, electromagnetic, infrared or semiconductor media. Some more specific examples of processor-usable media include, but are not limited to, a portable magnetic computer diskette, such as a floppy diskette, zip disk, hard drive, random access memory, read only memory, flash memory, cache memory, and/or other configurations capable of storing programming, data, or other digital information.

At least some embodiments or aspects described herein may be implemented using programming stored within appropriate storage circuitry 34 described above and configured to control appropriate processing circuitry 32. For example, programming may be provided via appropriate articles of manufacture including, for example, embodied within media discussed above.

Device components 36 include additional electrical components of the hard imaging device 10. For example, device components 36 may include sensors, pumps, motors, a user interface, variable valves, and other additional electrical components which may be controlled or monitored by processing circuitry 32. In one more specific example, motors may drive one or more rollers described below.

Figure 3:
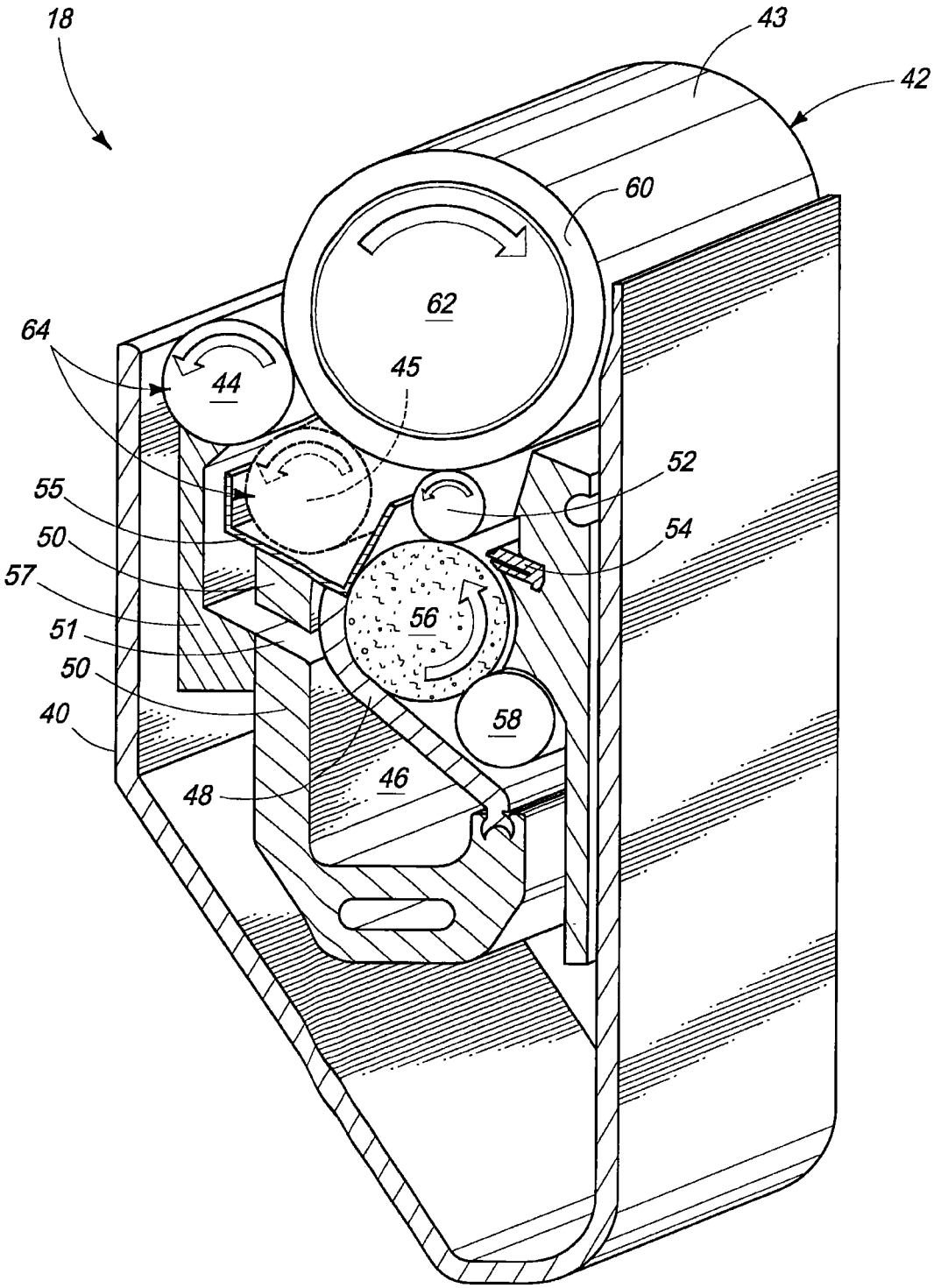
FIG. 3 is an isometric view a development assembly of a hard imaging device according to one embodiment.

Referring to FIG. 3, details of one embodiment of development assembly 18 of image engine 8 are shown. A single arrangement of development assembly 18 of FIG. 3 may be used for monochrome hard imaging devices 10 in one embodiment. In addition, a plurality of the arrangements of assemblies 18 of FIG. 3 may be used for different colors of color hard imaging devices 10 in one embodiment. In one example (e.g., including a plurality of development assemblies 18 for respective separations), the assemblies 18 may be spaced from imaging member 12 when the assemblies are not developing latent images and may be individually moved to a development position such that the development assembly 18 provides the appropriate color marking agent to the imaging member 12 at an appropriate moment in time to develop latent images on the imaging member 12.

In one embodiment, the example development assembly 18 includes a tray 40 which partially houses a developer member 42, such as a roller, and other components. Although not shown in FIG. 3, imaging member 12 is provided adjacent to developer member 42 and an outer surface 43 of developer member 42 is configured to move (e.g., rotate) to provide a layer of marking agent to a rotating outer surface of the imaging member 12 to develop latent images formed upon the outer surface of the imaging member 12. In one embodiment, developer member 42 includes a conductive polyurethane outer layer 60 provided about a metal core 62.

During imaging operations, a liquid marking agent may be introduced from a reservoir (not shown) into development assembly 18 at an internal chamber 46 defined by a back support member 48 and a support member 50. The liquid marking agent may be pumped into chamber 46 at a rate of approximately 10 l/min in one embodiment. It is desirable in one embodiment to provide substantially consistent flow speed, pressure and saturation of the marking agent along the length of the developer member 42 to reduce print defects. The received marking agent flows upwards through a chamber 51 of a manifold defined by a wall 57 to the surface 43 of developer member 42 and a charging assembly 64 which includes one or more charging member(s).

The charging member(s) may be dynamically moving in one embodiment during imaging operations. The charging member(s) provide substantially an entirety of the electrical field with respect to the developer member 42 which is used to direct ink particles to the outer surface 43 of the developer member 42 to implement formation of a layer of ink particles upon the developer member 42 in one embodiment as described in further detail below. The layer of ink particles formed upon the outer surface 43 of the developer member 42 by development assembly 18 is subsequently used to develop the latent images upon the imaging member 12 in one embodiment.

The liquid marking agent is provided to saturate the nips of the charging member(s) with the developer member 42 in one embodiment. In another arrangement described below, the charging member(s) may be immersed in a bath of the marking agent to saturate the nips. It is desired in some embodiments to achieve appropriate optical density on printed media which is accomplished in one embodiment of developing a layer of ink particles with a desired ink density, such as 20-30% ink solids, and thickness, such as 5-8 microns, upon the surface 43 of the developer member 42 in one illustrative embodiment. The liquid marking agent used with the development assembly 18 may have a density of solids (e.g., ink particles and charge directors) of approximately 3.5%, 7% or 10% in example embodiments. In more specific examples, where a single charging member is used, the density of the liquid marking agent may be approximately 10% while dual charging member embodiments may use liquid marking agents having a density of approximately 6%. Other embodiments are possible.

In the arrangement depicted in FIG. 3, the charging assembly 64 includes two charging members 44, 45. As mentioned above in one embodiment, components in the developer assemblies 18 provide ink to saturate the nips of the charging members 44, 45 during imaging operations. Other numbers of charging members (more or less than two) may be provided in other embodiments. For example, in some embodiments described below, charging member 45 is omitted. The charging members 44, 45 may be implemented as roller members, such as roller electrodes, which may be electrically biased in some example embodiments described below. The charging members 44, 45 may be corrosion resistant and include steel core rollers with chrome or electroless nickel plating in one embodiment.

The depicted charging members 44, 45 contact surface 43 of developer member 43 in the illustrated example arrangement of FIG. 3. In the depicted arrangement where the charging members 44, 45 contact surface 43 of developer member 42, the charging members 44, 45 may be individually biased against surface 43 by a force of approximately 100-300 N/m length in one embodiment. A cap 55 may operate to collect marking agent about charging member 45 in the illustrated example. In other embodiments, one or more of the charging members may be spaced from surface 43. For example, in some embodiments described below, charging member 45 may be spaced from surface 43.

In addition, in the illustrated embodiment of FIG. 3, the charging members 44, 45 rotate with the direction of rotation of developer member 42 as shown. In other embodiments, one or more of the charging members may rotate against (in an opposite direction) with respect to the direction of rotation of the developer member 42. For example, in some embodiments described below, charging member 45 may rotate opposite to the developer member 42 in arrangements where charging member 45 is spaced from surface 43 of developer member 42 while charging member 44 contacts surface 43 and rotates with surface 43.

Further with respect to the illustrated embodiment of FIG. 3, the outer surfaces of charging members 44, 45 which contact surface 43 may rotate at substantially the same rotational velocity as surface 43 of developer member 42 in one example. In other embodiments, surfaces of one or more of the charging members may individually rotate at a different rotational velocity with respect to the rotational velocity of the surface 43 of developer member 42. For example, in some embodiments described below, the surface of charging member 45 may rotate at a different velocity compared with surface 43 of developer member 42 in arrangements where charging member 45 is spaced from developer member 42. In one more specific example, the surface of charging member 45 may rotate opposite to (i.e., against) and slower (e.g., one-half the rotational velocity) than the rotation of surface 43 of developer member 42. In this specific example, the surface 43 of the developer member 42 may rotate clockwise at 2 m/s and the surface of the charging member 45 may rotate clockwise at 1 m/s.

Charging members 44, 45 which contact the surface 43 of developer member 42 may be referred to as squeegee members in some embodiments. Squeegee member(s) operate to form nips with surface 43 of developer member 42 and to provide a substantially uniform layer of marking agent upon surface 43 of developer member 42. In one embodiment, squeegee member(s) remove excess carrier fluid of the marking agent and pack down a layer of ink particles of the marking agent upon surface 43 in arrangements which utilize a liquid ink marking agent. The packed down concentrated layer of ink particles upon surface 43 may be transferred to imaging member 12 to develop latent images upon the imaging member 12 in the described example.

The members 42, 44, 45 may have different diameters in different embodiments. For example, developer member may have a diameter of 40 mm in one embodiment. Charging members 44, 45 may individually have a diameter of 16 mm in one embodiment. In one example of an embodiment which only includes a single charging member (i.e., member 44), the charging member may have a larger diameter, such as approximately 30 mm. Other embodiments are possible.

Following development and selective transfer to the imaging member 12, cleaner roller 52 operates to remove untransferred ink particles from surface 43 of developer member 42. A wiper 54 operates to remove ink particles from cleaner roller 52 and a sponge roller 56 operates to mix the removed ink particles with other liquid marking agent that is left over after passing around charging member 45. A squeezer roller 58 operates to wring out the sponge roller 56 in the illustrated embodiment.

In some embodiments as discussed, the charging assembly 64 generates an electrical field relative to the developer member 42 to implement the formation of a substantially uniform layer of the ink particles upon the surface 43 of the developer member 42. For example, in some liquid marking agents, charge director molecules may be attached to ink particles of the liquid marking agent. The charge directors include both positive and negative ions. However, as the marking agent passes through channel 51 towards nips between charging members 44, 45 of charging assembly 64, the liquid marking agent is subject to an electrical field from the charging members 44, 45 which may be biased differently than the developer member 42. In one example, charging members 44, 45 may be biased at −900 V and −2500 V, respectively, and developer member 42 may be biased at −500 V in one embodiment. The generated electrical field operates to strip away the positive ions of the charge directors leaving the ink particles negatively charged. The generated electrical field operates to direct the negatively charged ink particles to surface 43 of developer member 42 in one embodiment.

Additional components of the development assembly 18 may also be electrically biased in one embodiment to facilitate imaging operations. For example, support member 50 may be unbiased or biased at −3000 V. Cleaner roller 52 may be biased at −150 V in one embodiment.

Figure 4:
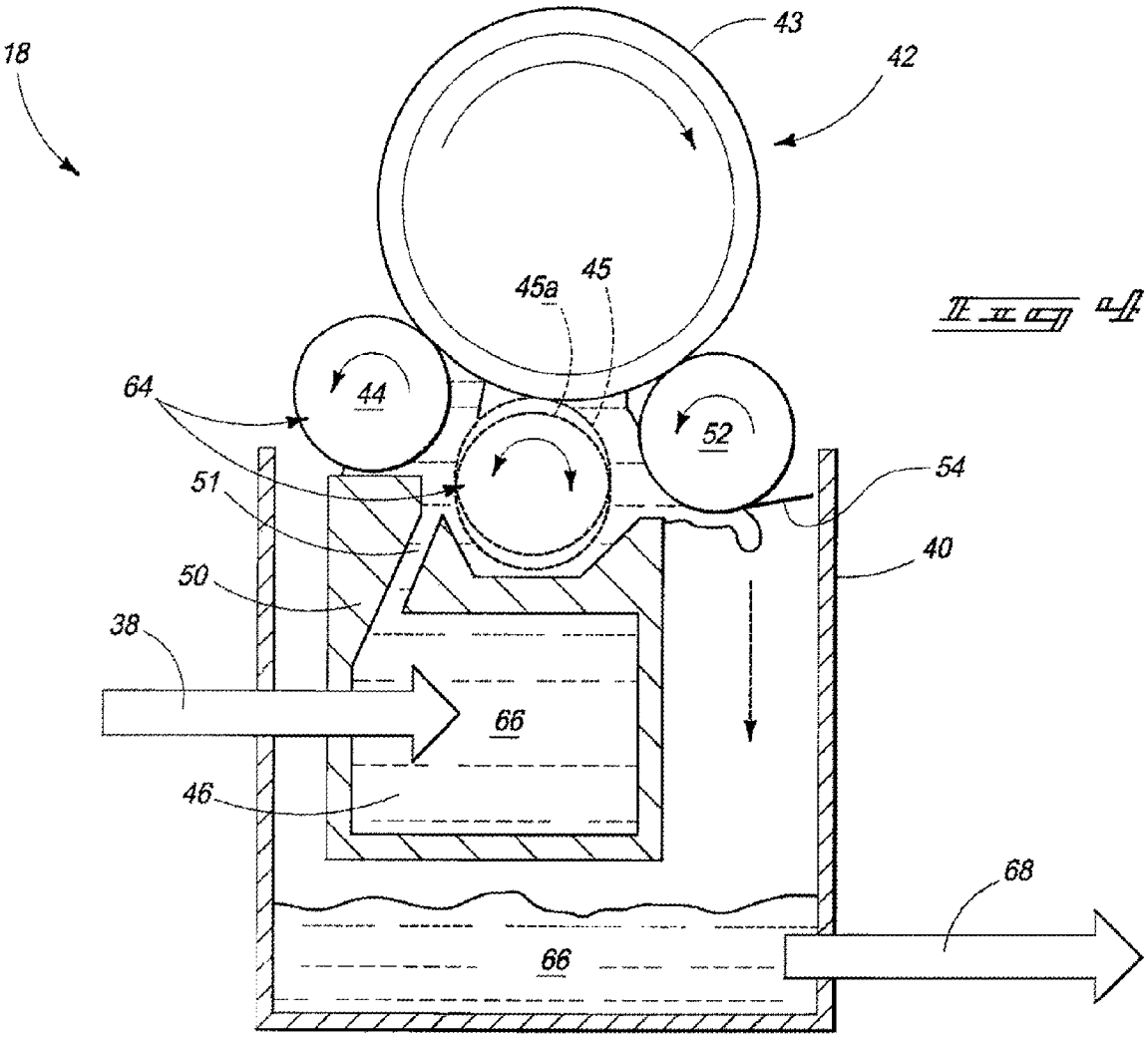
FIG. 4 is an illustrative representation of a development assembly of a hard imaging device according to one embodiment.
Figure 11:
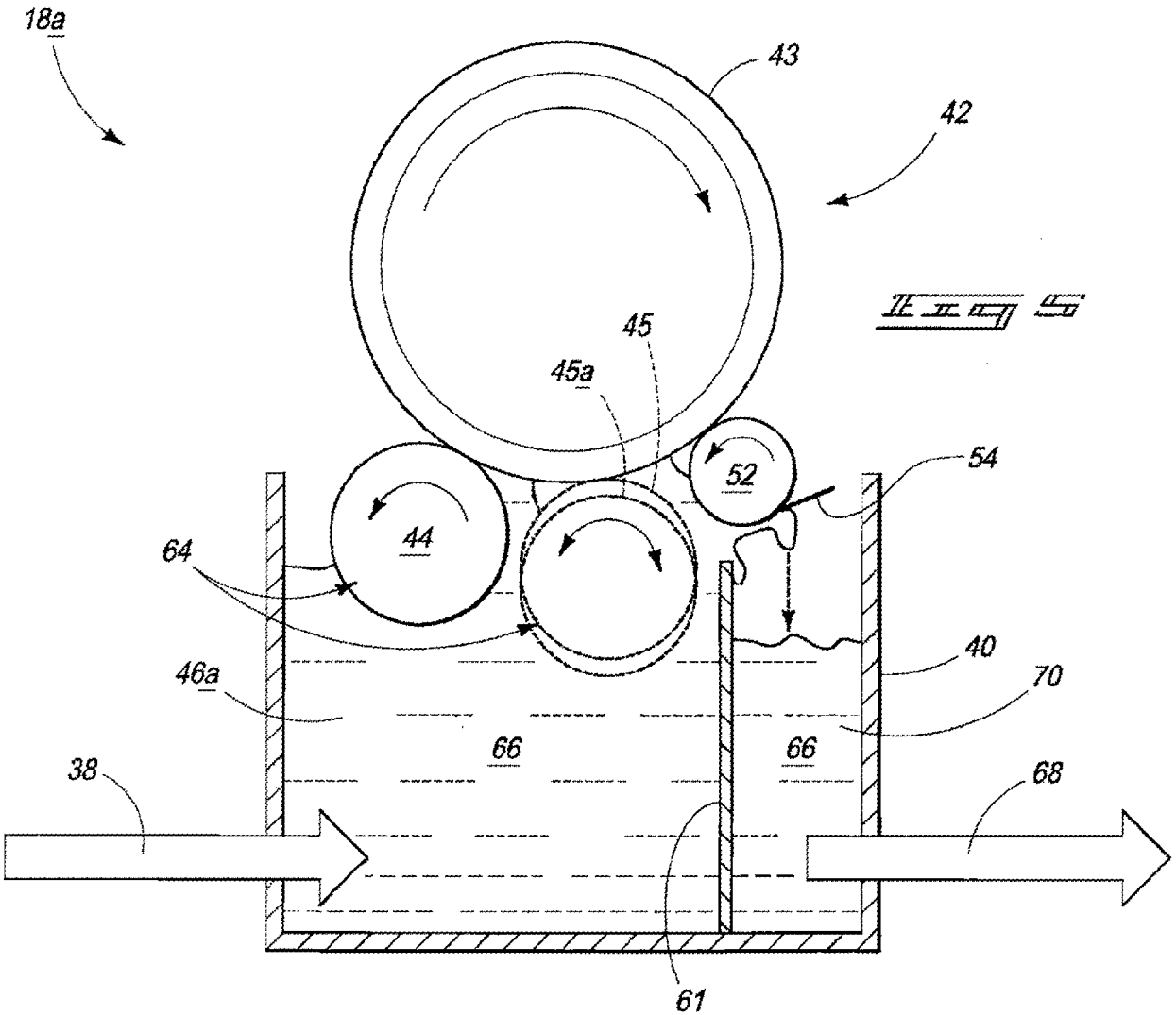

Referring to FIGS. 4-5, a plurality of example embodiments of charging assembly 64 are described. Other configurations of the charging assembly 64 are possible. In addition, the depicted embodiments are illustrative representations and some variances exist with respect to the embodiment of FIG. 3 although common elements are represented by common reference numbers.

Referring to FIG. 4, a liquid marking agent 66 may be provided to internal chamber 46 via a supply connection 38 from an external source of liquid marking agent 66. The liquid marking agent 66 may be urged through channel 51 (e.g., via a pump which is not shown) towards charging assembly 64. In one configuration of charging assembly 64, plural charging members 44, 45 are provided in contact with surface 43 of developer member 42. In such an embodiment, the surfaces of charging members 44, 45 may rotate in the same direction with one another and at substantially the same rotational velocity as surface 43 of the developer member 42. Furthermore, both charging members 44, 45 operate as squeegee members in such an arrangement.

In another embodiment of charging assembly 64, charging member 45 may be omitted and charging member 44 may be positioned to contact surface 43 of developer member 64. In such an embodiment, the charging member 44 may rotate in the same direction with the surface 43 and at substantially the same rotational velocity as surface 43 of the developer member 42.

In another embodiment of charging assembly 64, charging member 45 may be located at a position 45*a* spaced from surface 43 of developer member 42 and charging member 44 may be positioned to contact surface 43 of developer member 64. In one embodiment, a gap of approximately 0.5 mm may be provided between charging member 45 and surface 43 although other gap sizes may be used in other embodiments. In one embodiment, the surface of charging member 44 may rotate in the same direction with surface 43 and at substantially the same rotational velocity as surface 43 of the developer member 42. Furthermore, the surface of the charging member 45 may rotate in a direction opposite to and against the rotational direction of surface 43 of developer member 42 and at approximately half the rotational velocity of surface 43 of the developer member 42 in one embodiment. In one arrangement, providing the charging member 45 in a spaced relationship from surface 43 and rotating the charging member 45 in the opposite direction has been observed to provide a reduced amount of image defects in hard images compared with the other described arrangements of charging assembly 64.

Cleaner roller 52 operates to remove marking agent 66 which remains upon surface 43 following development. Wiper 54 operates to cause the removed marking agent 66 to fall downwards to the bottom of tray 40 where the marking agent 66 is collected. The marking agent 66 may be removed from tray 40 via an exhaust connection 68 for re-mixing and possible re-use in some examples. As mentioned above, FIG. 4 is illustrative and rollers 56, 58 of FIG. 3 have been omitted in the figure but may be utilized if desired.

Referring to FIG. 5, another embodiment of development assembly is shown as reference 18*a*. In the illustrated embodiment, tray 40 defines a different internal chamber 46*a* which receives the liquid marking agent 66. Furthermore, an internal wall 61 defines a collection reservoir 70 which collects marking agent removed from surface 43 of developer member 42 after development in one embodiment. The marking agent 66 may be removed from collection reservoir 70 via an exhaust connection 68 for re-mixing and possible re-use in some examples.

In the illustrated configuration of FIG. 5, the charging members 44, 45 may be immersed in a bath of the fresh liquid marking agent 66 within internal chamber 46*a*. Additionally, the recycled marking agent 66 is separate in reservoir 70 from the fresh marking agent 66.

In the illustrated example of FIG. 5, the different configurations of charging members 44, 45 of charging assembly 64 described above with respect to FIG. 4 may also be utilized.

Figure 6:
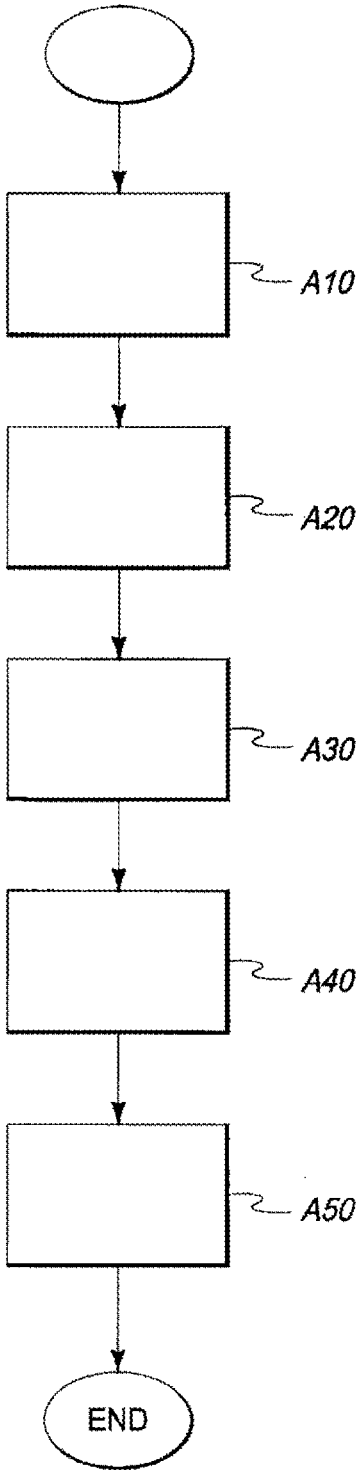
FIG. 6 is a flow chart of a method of forming hard images according to one embodiment.

Referring to FIG. 6, one example method of implementing hard imaging operations is discussed according to one embodiment. Other methods including more, less and/or alternative acts are possible.

At an act A10, the developer member rotates during imaging operations. Charging member(s) of the charging assembly may also rotate with or against the developer member as discussed above.

At an act A20, a liquid marking agent is provided to saturate the nips of the charging member(s) and the developer member. In example embodiments, the liquid marking agent may be pumped to the charging members using a manifold or the charging member(s) may be immersed in a bath of the liquid marking agent. Other embodiments are possible.

At an act A30, the charging member(s) may provide an electrical field relative to the developer member to direct ink particles of the liquid marking agent to the developer member to form a layer of the ink particles upon the surface of the developer member.

At an act A40, one or more of the charging member(s) (e.g., acting as squeegee members) may remove excess carrier fluid from the surface of the developer member.

At an act A50, the layer of ink particles upon the surface of the developer member may be used to develop latent images upon an imaging member.

The example embodiments of the developer assemblies described herein may provide some advantages over other assemblies which utilize static electrodes which are configured in an arc about the surface of the developer member to generate an electrical field. For example, some of the described embodiments in this disclosure do not need to be as precisely machined and the relative positions of the charging members with respect to the developer member are not as critical compared with static electrode designs which may be designed to provide a precision gap about the outer surface of the developer member.

In addition, some of the charging assemblies of the present disclosure are more compact and occupy less area about the circumference of the developer member compared with the other designs using static electrodes which allows more open space and more freedom in design and placement of other components about the developer member.

The developer assemblies of some embodiments of the present disclosure may have lower requirements upon the developer member compared with some static electrode embodiments. For example, environmental stability is less important and shrinkage or swell of the developer member has less adverse impact on print quality. Similarly, runout and stiffness of the developer member are not as important because changes in the developer member do not directly translate to print quality.

Also, at least some of the developer assemblies of the present disclosure are less sensitive to contamination build up which may occur on some of the static electrodes of other designs. More specifically, the dynamically moving charging members of some of the disclosed embodiments may be easier to clean than some static electrode arrangements. For example, following imaging, the biasing voltage sources of the development assembly may be turned off and the charging members may continue to rotate which tends to wash the liquid marking agent from the charging members.

The protection sought is not to be limited to the disclosed embodiments, which are given by way of example only, but instead is to be limited only by the scope of the appended claims.

Further, aspects herein have been presented for guidance in construction and/or operation of illustrative embodiments of the disclosure. Applicant(s) hereof consider these described illustrative embodiments to also include, disclose and describe further inventive aspects in addition to those explicitly disclosed. For example, the additional inventive aspects may include less, more and/or alternative features than those described in the illustrative embodiments. In more specific examples, Applicants consider the disclosure to include, disclose and describe methods which include less, more and/or alternative steps than those methods explicitly disclosed as well as apparatus which includes less, more and/or alternative structure than the explicitly disclosed structure.

What is claimed is:

1. A liquid marking agent development assembly comprising:

a developer member comprising an outer surface; and a charging assembly adjacent to the outer surface of the developer member, and wherein the charging assembly comprises at least one roller member configured to provide an electrical field relative to the developer member and which electrical field is used to direct a plurality of ink particles of a liquid marking agent to the outer surface of the developer member and which ink particles upon the outer surface of the developer member are used to develop latent images upon an imaging member;

wherein a first of the roller members is configured to rotate in a direction opposite to and against a direction of movement of the outer surface of the developer member and a second of the roller members is configured to rotate in a direction with the direction of movement of the surface of the developer member.

2. The assembly of claim 1 wherein the at least one roller member of the charging assembly comprises plural roller members which are configured to provide the entirety of the electrical field relative to the developer member.

3. The assembly of claim 2 wherein the plural roller members contact the outer surface of the developer member.

4. The assembly of claim 2 wherein a first of the roller members is spaced from the outer surface of the developer member and a second of the roller members is positioned to contact the outer surface of the developer member.

5. The assembly of claim 1 wherein the at least one roller member contacts the outer surface of the developer member to remove at least some of a carrier fluid of the liquid marking agent from the outer surface of the developer member and wherein the at least one roller member is biased to have a voltage different than a voltage of the developer member to provide the electrical field.

6. A liquid marking agent development assembly comprising:

a developer member comprising an outer surface; and a charging assembly adjacent to the outer surface of the developer member, and wherein the charging assembly comprises a plurality of dynamically moving charging members configured to provide an electrical field relative to the developer member and which electrical field is used to direct a plurality of ink particles of a liquid marking agent to the outer surface of the developer member and which ink particles upon the outer surface of the developer member are used to develop latent images upon an imaging member;

wherein the plurality of dynamically moving charging members are to be biased to different voltages to generate the electrical fields; and wherein the charging member of the charging assembly comprises a first chars member spaced from the outer surface of the developer member and wherein the charging assembly further comprises a second charging member positioned to contact the outer surface of the developer member, and wherein the first charging member is configured to rotate in a direction opposite to and against a direction of movement of the surface of the developer member and the second charging member is configured to rotate in a direction with the direction of movement of the surface of the developer member.

7. A liquid marking agent hard imaging method comprising:

moving an outer surface of a developer member;

providing a liquid marking agent adjacent to the outer surface of the developer member;

using at least one roller member, providing an electrical field relative to the developer member and which electrical field is used to direct a plurality of ink particles of the liquid marking agent to the surface of the developer member and which ink particles upon the surface of the developer member are used to develop latent images; and while providing the electrical field, rotating a first of the roller members in a direction opposite to and against a direction of movement of the outer surface of the developer member and rotating a second of the roller members with the direction of movement of the outer surface of the developer member.

8. The method of claim 7 wherein the providing the entirety of the electrical field comprises providing using the at least one roller member comprising a plurality of roller members.

9. The method of claim 8 wherein the providing the entirety of the electrical field comprises providing using the plurality of roller members in contact with the outer surface of the developer member.

10. The method of claim 8 wherein the providing the entirety of the electrical field comprises providing using a first of the roller members spaced from the outer surface of the developer member and a second of the roller members in contact with the outer surface of the developer member.

11. The method of claim 10 further comprising during the providing, rotating an outer surface of the first of the roller members at a velocity less than a velocity of the outer surface of the developer member, and further comprising, using one of the roller members which is in contact with the outer surface of the developer member, removing at least some of a carrier fluid of the liquid marking agent from the outer surface of the developer member.

* * * * *

UNITED STATES PATENT AND TRADEMARK OFFICE

CERTIFICATE OF CORRECTION

PATENT NO. : 8,824,931 B2
APPLICATION NO. : 13/380013
DATED : September 2, 2014
INVENTOR(S) : Eric G. Nelson et al.

It is certified that error appears in the above-identified patent and that said Letters Patent is hereby corrected as shown below:

In column 9, line 35, in Claim 6, delete "fields;" and insert -- field; --, therefor.

In column 9, line 37, in Claim 6, delete "chars" and insert -- charging --, therefor.

Signed and Sealed this
Thirty-first Day of May, 2016

Michelle K. Lee

Michelle K. Lee
*Director of the United States Patent and Trademark Office*